US010738550B2

(12) United States Patent
Davis et al.

(10) Patent No.: US 10,738,550 B2
(45) Date of Patent: Aug. 11, 2020

(54) TREATMENT OF RECOVERED COMMERCIAL SOLIDS FOR USE IN OILFIELD FLUIDS

(71) Applicant: Halliburton Energy Services, Inc., Houston, TX (US)

(72) Inventors: Chesnee Lae Davis, Spring, TX (US); Katerina V. Newman, Houston, TX (US); Kimberly Jo Burrows, Kingwood, TX (US); William Walter Shumway, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/771,702

(22) PCT Filed: Dec. 7, 2015

(86) PCT No.: PCT/US2015/064200
§ 371 (c)(1),
(2) Date: Apr. 27, 2018

(87) PCT Pub. No.: WO2017/099705
PCT Pub. Date: Jun. 15, 2017

(65) Prior Publication Data

US 2018/0340382 A1 Nov. 29, 2018

(51) Int. Cl.

| | |
|---|---|
| ***E21B 43/40*** | (2006.01) |
| ***E21B 21/06*** | (2006.01) |
| ***E21B 21/01*** | (2006.01) |

(52) U.S. Cl.
CPC ..... *E21B 21/066* (2013.01); *E21B 21/01* (2013.01); *E21B 21/06* (2013.01); *E21B 21/068* (2013.01); *E21B 43/40* (2013.01)

(58) Field of Classification Search
CPC ..... E21B 21/066; E21B 21/01; E21B 21/068; E21B 43/40
See application file for complete search history.

(56) References Cited

U.S. PATENT DOCUMENTS

| | | | | |
|---|---|---|---|---|
| 2,982,401 | A * | 5/1961 | Talbot | E21B 21/066 209/2 |
| 4,502,963 | A | 3/1985 | Harmon | |
| 4,648,333 | A | 3/1987 | Mudd et al. | |
| 7,754,661 | B2 | 7/2010 | Smith et al. | |
| 9,346,995 | B2 | 3/2016 | Wagle et al. | |
| 2007/0221411 | A1 | 9/2007 | Butlet et al. | |
| 2007/0281867 | A1 * | 12/2007 | Massam | E21B 21/00 507/200 |

(Continued)

OTHER PUBLICATIONS

International Search Report and Written Opinion for PCT/US2015/064200 dated Sep. 22, 2016.

(Continued)

*Primary Examiner* — Silvana C Runyan
(74) *Attorney, Agent, or Firm* — Tenley Krueger; C. Tumey Law Group PLLC

(57) ABSTRACT

Disclosed are treatments of recovered commercial solids and use of the treated recovered commercial solids in well treatment fluids. Systems and methods are disclosed for chemically treating recovered commercial solids to remove contaminants and then recycling the recovered commercial solids by using them in a treatment fluid.

18 Claims, 4 Drawing Sheets

(56) References Cited

U.S. PATENT DOCUMENTS

| | | | | |
|---|---|---|---|---|
| 2008/0264691 | A1* | 10/2008 | Allen | E21B 21/003 175/66 |
| 2009/0020289 | A1* | 1/2009 | Sharif | B01D 61/002 166/305.1 |
| 2011/0186293 | A1 | 8/2011 | Gurmen et al. | |
| 2013/0062060 | A1 | 3/2013 | Kerfoot | |
| 2014/0175008 | A1 | 6/2014 | Mathis | |
| 2014/0209388 | A1* | 7/2014 | Jamison | E21B 7/00 175/65 |
| 2014/0231084 | A1* | 8/2014 | Varadaraj | E21B 41/0057 166/278 |
| 2014/0367501 | A1 | 12/2014 | Witthayapanyanon et al. | |
| 2015/0197998 | A1 | 7/2015 | Kapila et al. | |

OTHER PUBLICATIONS

Second Examiner's Letter for Application No. 3,002,550, dated Jun. 25, 2019.

* cited by examiner

TREATMENT OF RECOVERED COMMERCIAL SOLIDS FOR USE IN OILFIELD FLUIDS

BACKGROUND

Provided are systems and methods for treating recovered commercial solids and using the treated recovered commercial solids in well treatment fluids. More particularly, systems and methods are provided for chemically treating recovered commercial solids to remove contaminants and then recycling the recovered commercial solids by using them in a treatment fluid.

During the lifecycle of a well, various treatment fluids may be used to perform specific wellbore applications. For example, drilling fluids, completion fluids, stimulation fluids, fracturing fluids, etc. may all be used to perform various desired wellbore applications. Commercial solids may be used to adjust one or more properties of a treatment fluid so that the treatment fluid may be optimized for its respective application. Commercial solids are solid additives that are intentionally added to the treatment fluid to adjust one or more properties of the treatment fluid. This is in contrast with noncommercial solids, for example, drill cuttings within a drilling fluid, which are not intentionally added to the treatment fluid. An example of a commercial solid is a weighting agent. Weighting agents are solids with high specific gravities (e.g., >2.6) that are used to increase fluid density of a treatment fluid (i.e. intentionally adjusting the density property of the treatment fluid).

A drilling fluid is one type of treatment fluid which may contain commercial solids. During the drilling of a wellbore into a subterranean formation, a drilling fluid, also referred to as a drilling mud, may be continuously circulated from the surface down to the bottom of the wellbore being drilled and back to the surface again. The drilling fluid serves several functions, one of them being to transport wellbore cuttings up to the surface where they are separated from the drilling fluid. Another function of the drilling fluid is to provide hydrostatic pressure on the walls of the drilled wellbore so as to prevent wellbore collapse and the resulting influx of gas or liquid from the formations being drilled. It may be important to optimize a drilling fluid so that it can better perform its intended functions. One way in which the drilling fluid may be optimized is to add commercial solids capable of adjusting the properties of the drilling fluid to their desired state. Commercial solids, such as weighting agents, may be added to the drilling fluid to increase the density of the drilling fluid such that it may be able to move drill cuttings to the surface and/or maintain hydrostatic pressure in the wellbore.

After the treatment fluid has been used, (e.g., after drilling is completed with the drilling fluid), the treatment fluid may be disposed. The chosen disposal method may also dispose of any commercial solids used with the treatment fluid. Commercial solids may be expensive, and therefore disposing of the commercial solids alongside the treatment fluid, is wasteful. Recovery of the commercial solids may be possible; however, even if the commercial solids are recovered prior to disposal of the treatment fluid, the recovered commercial solids may not be fit for reuse in a treatment fluid. For example, the properties of the recovered commercial solids may have been altered by their use in a treatment fluid, making them unfit for their intended purpose (e.g., to adjust the properties of a treatment fluid). Additionally, the recovered commercial solids may be contaminated with contaminants from the wellbore or the treatment fluid which may adversely affect a different treatment fluid to which addition of the commercial solids is desired.

Typically, commercial solids are not recovered because there is no practical way to recycle them. A method of recycling commercial solids, may reduce well expenses, may reduce waste expenses, and may reduce the overall environmental impact of the wellbore operation.

BRIEF DESCRIPTION OF THE DRAWINGS

These drawings illustrate certain aspects of some examples of the present invention, and should not be used to limit or define the invention.

DETAILED DESCRIPTION

Figure 1:
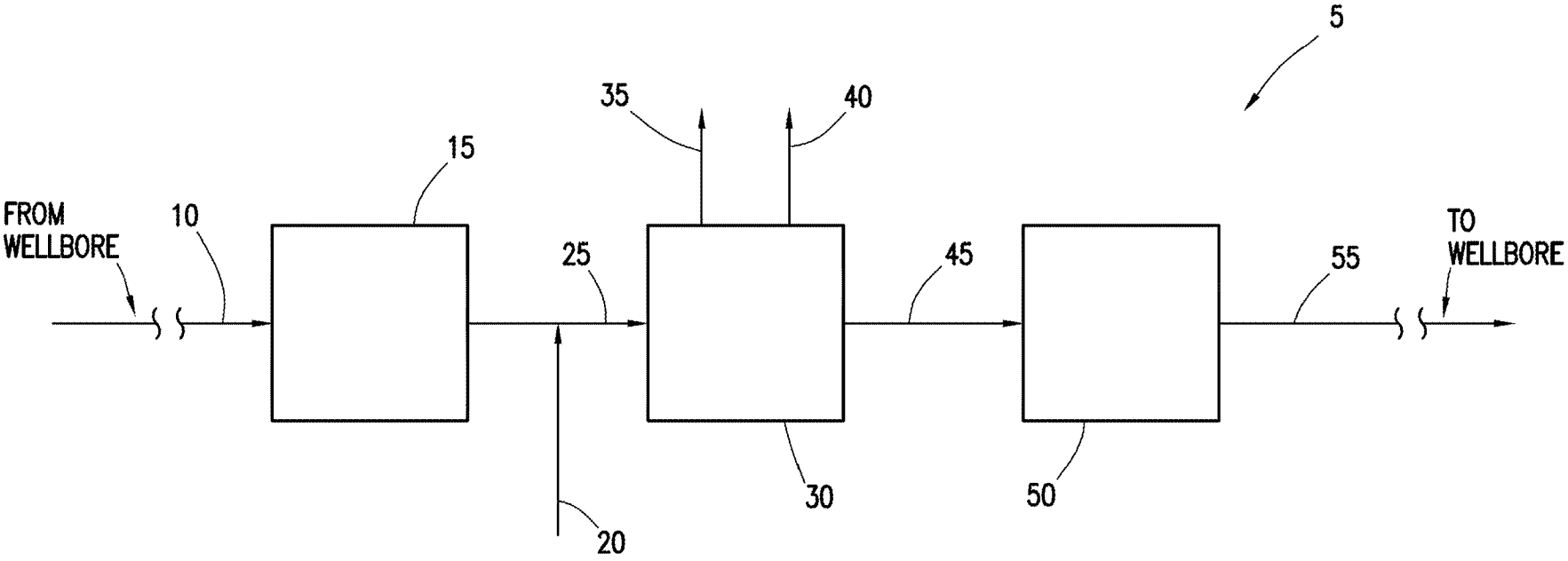
FIG. 1 is a block flow diagram illustrating an example of a commercial solids treating and recycling system.

Provided are systems and methods for treating recovered commercial solids and using the treated recovered commercial solids in well treatment fluids. More particularly, systems and methods are provided for chemically treating recovered commercial solids to remove contaminants and then recycling the recovered commercial solids by using them in a treatment fluid.

The methods and systems disclosed herein may allow for recovered commercial solids to be recycled and used again in a treatment fluid. Advantageously, the methods and systems disclosed herein may allow for recovered commercial solids to regain at least a portion of any lost functionality from their use in a treatment fluid. Further advantageously, the methods and systems may remove any contaminants which could adversely affect a new treatment fluid in which the use of the recovered commercial solids is desired. Additionally, the operator may be able to further reduce costs by disposing of less commercial solids. Further, the operator may reduce the overall environmental impact of the well operation, relative to an operator who does not recycle or even recover their commercial solids. This may be of a particular advantage in well operations in which productivity is low and the cost of necessary commercial solids is high.

The methods and systems described herein comprise recovered commercial solids. Commercial solids are solid additives that are intentionally added to the treatment fluid to adjust one or more properties of the treatment fluid. This is in contrast with noncommercial solids, for example, drill cuttings within a drilling fluid, which are not intentionally added to the treatment fluid to adjust a property of the treatment fluid. In order to be recoverable, the commercial solids should not dissolve or otherwise change to a different phase of matter. For example, calcium carbonate may dissolve under some wellbore conditions. In these instances, calcium carbonate may not be recoverable. Further, in order to prepare the commercial solids for recycling, a chemical treatment may be applied to remove contaminants and restore the properties of the commercial solids. In order to be recycled, the recovered commercial solids should not dissolve or otherwise change to a different phase of matter upon use of the prescribed chemical treatment disclosed by the methods and systems described herein. Examples of commercial solids may include weighting agents, viscosifying agents, bridging agents, clays, or combinations thereof. Weighting agents may be any high specific gravity solid added to a treatment fluid to increase the density of the treatment fluid. For example, the weighting agents may have a specific gravity of greater than 2.6. Specific examples of weighting agents include barite, hematite, calcium carbonate, siderite, ilmenite, permanganate, bentonite, and combinations thereof. Dissolved salts which raise fluid density are not typically referred to as weighting agents and such materials would not be suitable for the systems and methods disclosed herein, as they would not be recoverable. Viscosifying agents are any solid material used to impart viscosity and suspension properties to a fluid. Examples of viscosifying agents include clays, polymers, biopolymers, and combinations thereof. Bridging agents are solids that may be added to a drilling fluid to bridge across the pore throat or fractures of an exposed rock thereby building a filter cake to prevent loss of whole mud or excessive filtrate. Examples of bridging agents include sized calcium carbonate, sized marble, iron carbonate, polylactic acid, orthoesters, polyorthoesters, acid soluble carbonate, aragonite, chitosan, ground oyster shell, magnesium oxide, manganese oxide, and combinations thereof.

The methods and systems described herein may comprise treatment fluids. Any treatment fluid used during any phase of a wellbore operation may be used with methods and systems described herein, provided that the treatment fluid comprises commercial solids which may be recoverable (e.g., completion fluids, packer fluids, etc. are typically solids-free fluids). Examples of treatment fluids which may be used in the methods and systems described herein include, but are not to be limited to, drilling fluids, fracturing fluids, stimulation fluids, multiphase fluids, water-based fluids, oil-based fluids, acid-based fluids, foam-based fluids, and the like. Drilling fluids may be any number of liquid and gaseous fluids, as well as mixtures of fluids and solids (e.g., solid suspensions, mixtures and emulsions of liquids, gases and solids, etc.) used to drill a wellbore into a subterranean formation. Drilling fluids may contain various types of commercial solids (e.g., weighting agents) which may be recoverable in certain instances. Stimulation fluids are treatment fluids prepared for stimulation purposes; most stimulation fluids are acid or solvent-based. Fracturing fluids are a subset of stimulation fluids and may be injected into a well as part of a stimulation operation. Fracturing fluids may contain various types of commercial solids, (e.g., proppants) which may be recoverable in certain instances. These are just a few examples, and it is to be understood that any treatment fluid comprising recoverable commercial solids may be used with the methods and systems disclosed herein.

The commercial solids may be recovered using any suitable commercial solids recovery method. One example of a commercial solids recovery method is to use a thermal desorption unit to isolate the commercial solids from the treatment fluid. This generally may comprise passing a treatment fluid comprising commercial solids through a thermal desorption unit, where the fluid component of the treatment fluid is distilled, leaving behind any solids. A thermal desorption unit may not degrade the solids and may also remove some of the volatile organics. Separation may be necessary in some cases to separate noncommercial solids from commercial solids. For example, if the treatment fluid was used as a drilling fluid, the drill cuttings may need to be separated from the commercial solids. This may be accomplished in any manner as would occur to one of ordinary skill in the art, including processing via centrifuges, shakers, hydrocyclones, coagulation, flocculation, etc. A thermomechanical cuttings cleaner may also be used to remove drill cuttings and separate oil and water from solids. The separation of noncommercial solids from the commercial solids may be performed prior to or subsequent to the separation of the commercial solids from the treatment fluid.

The commercial solids may be recovered with additional solids that may have been present in the treatment fluid (e.g., drilling fluid). Without limitation, a solid mixture may be recovered, wherein the recovered solid mixture may comprise commercial solids and one or more of drill cuttings, drilling mud waste recovery, oil based drilling fluid waste recovery, water based drilling fluid waste recovery, brine based drilling fluid waste recovery, or combinations thereof. This solid mixture may be treated with the chemical decontaminant. Treatment of the solid mixture with the chemical decontaminant may be performed as described in more detail herein for treatment of the commercial solids. Without limitation, treatment with the chemical decontaminant may occur at any point in the process, including before recovery of the solid mixture from the original treatment fluid or after the solid mixture has been recovered from the treatment fluid.

The recovered commercial solids may comprise contaminants. The contaminants may be any contaminant which may contact the commercial solid. The contaminants may be naturally occurring, and natively present in the subterranean formation, or the contaminants may be introduced into the formation via well or other operations, for example, as an additive used in other wellbore applications. The word "contaminant" does not necessarily imply an environmental contaminant, but instead refers to any such material which is affixed to or otherwise has left a residue or trace on a recovered commercial solid, with such material not being a natural part of the commercial solid as it was originally used in the treatment fluid. Examples of contaminants may include, but should not be limited to, fluid loss control agents, emulsifiers, dispersion aids, corrosion inhibitors, emulsion thinners, emulsion thickeners, viscosifying agents, gelling agents, crosslinking agents, surfactants, lost circulation materials, pH control additives, emulsion breakers, defoaming agents, biocides, stabilizers, scale inhibitors, gas hydrate inhibitors, oxidizers, reducers friction reducers, clay stabilizing agents, cement set accelerators, cement set retarders, drill solids, bridging agents, or any combination thereof.

The contaminants may be removed from the commercial solids using a chemical decontamination treatment. Generally, the commercial solids may be treated by contacting the commercial solids with at least one chemical decontaminant. The chemical decontaminates may generally comprise an acid, a chelating agent, a complexing agent, a thinner, or a combination thereof. Specific examples of chemical decontaminants include, but should not be limited to, sodium acid pyrophosphate, potassium acid pyrophosphate, formic acid, acetic acid, hydrochloric acid citric acid, methyl sulfonic acid, ethylenediaminetetraacetic acid, cyclohexane-1,2-diaminetetraacetic acid, pentetic acid, gluconic acid, tannic acid, malic acid, glycolic acid, pyruvic acid, glutamic acid, fumaric acid, succinic acid, isocitric acid, pimelic acid, oxalic acid, malonic acid, gluratic acid, adipic acid, propionic acid, butyric acid, carboxylic acid, sodium citrate, disodium citrate, potassium citrate, sodium carbonate, potassium carbonate, sodium bicarbonate, potassium bicarbonate, sodium tripolyphosphate, sodium hexametaphosphate, monopotassium dihydrogen orthophosphate, dipotassium hydrogen orthophosphate, tripotassium orthophosphate, monosodium phosphate, dipotassium phosphate, trisodium phosphate, tetrasodium pyrophosphate, sodium aluminum phosphate, sodium potassium tartrate, or any combination thereof. The chemical decontaminant may be added to the commercial solids in any amount sufficient to remove the contaminants. For example, the chemical decontaminant may be added to the commercial solids in an amount of about 0.01% by volume to about 10% by volume. In some examples, wherein the commercial solids are treated while disposed in a treatment fluid, it may be appropriate to add the chemical decontaminant until the pH of the treatment fluid reaches a desired level. In these examples, the chemical decontaminant chosen may have an effect on pH and thus the change in pH may be measured. Further, the amount in which the pH may be adjusted depends on a variety of factors including the chemical decontaminant chosen, the initial pH of the treatment fluid, the type of commercial solid used, etc.

The recovered commercial solids may be contacted with the chemical decontaminant at any time as would occur to one of ordinary skill in the art. This may include contacting the recovered commercial solids before or after they are recovered from the treatment fluid in which they were originally used. "Recovered," is therefore not to be used to convey when the commercial solids may be decontaminated with the chemical decontaminant, it is merely used to convey that the treated commercial solids may be recovered and recycled if desired.

An example method for decontaminating a commercial solid may comprise recovering the commercial solid from a first treatment fluid, wherein the first treatment fluid was recovered from a wellbore. The method may further comprise contacting the commercial solid with a chemical decontaminant to produce a decontaminated commercial solid. The method may further comprise preparing a second treatment fluid comprising the commercial solid. The method may further comprise introducing the second treatment fluid comprising the commercial solid into a wellbore. The step of contacting the commercial solid with the chemical decontaminant may comprise contacting a recovered solid mixture with the chemical decontaminant, wherein the recovered solid mixture comprises the commercial solid and one or more solids selected from the group consisting of drill cuttings, drilling mud waste recovery, oil based drilling fluid waste recovery, water based drilling fluid waste recovery, brine based drilling fluid waste recovery and combinations thereof. The commercial solid may be a weighting agent selected from the group consisting of barite, hematite, siderite, ilmenite, permanganate, and combinations thereof. The chemical decontaminant may be selected from the group consisting of an acid, a chelating agent, a complexing agent, a thinner, and combinations thereof. The chemical decontaminant may be selected from the group consisting of sodium acid pyrophosphate, potassium acid pyrophosphate, formic acid, acetic acid, hydrochloric acid citric acid, methyl sulfonic acid, ethylenediaminetetraacetic acid, cyclohexane-1,2-diaminetetraacetic acid, pentetic acid, gluconic acid, tannic acid, malic acid, glycolic acid, pyruvic acid, glutamic acid, fumaric acid, succinic acid, isocitric acid, pimelic acid, oxalic acid, malonic acid, gluratic acid, adipic acid, propionic acid, butyric acid, carboxylic acid, sodium citrate, disodium citrate, potassium citrate, sodium carbonate, potassium carbonate, sodium bicarbonate, potassium bicarbonate, sodium tripolyphosphate, sodium hexametaphosphate, monopotassium dihydrogen orthophosphate, dipotassium hydrogen orthophosphate, tripotassium orthophosphate, monosodium phosphate, dipotassium phosphate, trisodium phosphate, tetrasodium pyrophosphate, sodium aluminum phosphate, sodium potassium tartrate, and combinations thereof. The first treatment fluid may be a treatment fluid selected from the group consisting of drilling fluids, fracturing fluids, stimulation fluids, multiphase fluids, water-based fluids, oil-based fluids, acid-based fluids, foam-based fluids, and combinations thereof. The second treatment fluid may be a treatment fluid selected from the group consisting of drilling fluids, fracturing fluids, stimulation fluids, multiphase fluids, water-based fluids, oil-based fluids, acid-based fluids, foam-based fluids, and combinations thereof. The first treatment fluid may be a different type of treatment fluid from the second treatment fluid. The commercial solid may comprise a contaminant selected from the group consisting of fluid loss control agents, emulsifiers, dispersion aids, corrosion inhibitors, emulsion thinners, emulsion thickeners, viscosifying agents, gelling agents, crosslinking agents, surfactants, lost circulation materials, pH control additives, emulsion breakers, defoaming agents, biocides, stabilizers, scale inhibitors, gas hydrate inhibitors, oxidizers, reducers friction reducers, clay stabilizing agents, cement set accelerators, cement set retarders, drill solids, bridging agents, and combinations thereof; and wherein the contacting the commercial solid with a chemical decontaminant to produce a decontaminated commercial solid comprises removing the selected contaminant or combination of contaminants. The step of recovering the commercial solid from a first treatment fluid may occur prior to the contacting the commercial solid with a chemical decontaminant to produce a decontaminated commercial solid. The contacting the commercial solid with a chemical decontaminant to produce a decontaminated commercial solid may occur prior to the recovering the commercial solid from a first treatment fluid. The contacting the commercial solid with a chemical decontaminant to produce a decontaminated commercial may occur in the second treatment fluid.

Another example method for decontaminating a commercial solid may comprise adding the commercial solid to a treatment fluid comprising a chemical decontaminant such that the chemical decontaminant contacts the commercial solid to produce a decontaminated commercial solid. The method may further comprise introducing the treatment fluid comprising the decontaminated commercial solid and the chemical decontaminant in a wellbore. The step of adding in the commercial solid to a treatment fluid may comprise adding a recovered solid mixture to the treatment fluid, wherein the recovered solid mixture comprises the commercial solid and one or more solids selected from the group consisting of drill cuttings, drilling mud waste recovery, oil based drilling fluid waste recovery, water based drilling fluid waste recovery, brine based drilling fluid waste recovery and combinations thereof. The commercial solid may be a weighting agent selected from the group consisting of barite, hematite, siderite, ilmenite, permanganate, and combinations thereof. The chemical decontaminant may be selected from the group consisting of an acid, a chelating agent, a complexing agent, a thinner, and combinations thereof. The chemical decontaminant may be selected from the group consisting of sodium acid pyrophosphate, potassium acid pyrophosphate, formic acid, acetic acid, hydrochloric acid citric acid, methyl sulfonic acid, ethylenediaminetetraacetic acid, cyclohexane-1,2-diaminetetraacetic acid, pentetic acid, gluconic acid, tannic acid, malic acid, glycolic acid, pyruvic acid, glutamic acid, fumaric acid, succinic acid, isocitric acid, pimelic acid, oxalic acid, malonic acid, gluratic acid, adipic acid, propionic acid, butyric acid, carboxylic acid, sodium citrate, disodium citrate, potassium citrate, sodium carbonate, potassium carbonate, sodium bicarbonate, potassium bicarbonate, sodium tripolyphosphate, sodium hexametaphosphate, monopotassium dihydrogen orthophosphate, dipotassium hydrogen orthophosphate, tripotassium orthophosphate, monosodium phosphate, dipotassium phosphate, trisodium phosphate, tetrasodium pyrophosphate, sodium aluminum phosphate, sodium potassium tartrate, and combinations thereof. The treatment fluid may be a treatment fluid selected from the group consisting of drilling fluids, fracturing fluids, stimulation fluids, multiphase fluids, water-based fluids, oil-based fluids, acid-based fluids, foam-based fluids, and combinations thereof. The commercial solid may comprise a contaminant selected from the group consisting of fluid loss control agents, emulsifiers, dispersion aids, corrosion inhibitors, emulsion thinners, emulsion thickeners, viscosifying agents, gelling agents, crosslinking agents, surfactants, lost circulation materials, pH control additives, emulsion breakers, defoaming agents, biocides, stabilizers, scale inhibitors, gas hydrate inhibitors, oxidizers, reducers friction reducers, clay stabilizing agents, cement set accelerators, cement set retarders, drill solids, bridging agents, and combinations thereof; and wherein the chemical decontaminant removes the selected contaminant or combination of contaminants from the commercial solid comprises removing the selected contaminant or combination of contaminants.

An example system for decontaminating a commercial may comprise a treatment fluid, wherein the treatment fluid comprises a commercial solid. The system may further comprise a chemical decontaminant. The system may further comprise a fluid monitoring and handling system, wherein the fluid monitoring and handling system comprises a commercial solids recovery unit, and a chemical decontaminant storage vessel. The treatment fluid may comprise a recovered solid mixture, wherein the recovered solids mixtures comprises the commercial solid and one or more solids selected from the group consisting of drill cuttings, drilling mud waste recovery, oil based drilling fluid waste recovery, water based drilling fluid waste recovery, brine based drilling fluid waste recovery and combinations thereof. The commercial solid may be a weighting agent selected from the group consisting of barite, hematite, siderite, ilmenite, permanganate, and combinations thereof. The chemical decontaminant may be selected from the group consisting of an acid, a chelating agent, a complexing agent, a thinner, and combinations thereof. The chemical decontaminant may be selected from the group consisting of sodium acid pyrophosphate, potassium acid pyrophosphate, formic acid, acetic acid, hydrochloric acid citric acid, methyl sulfonic acid, ethylenediaminetetraacetic acid, cyclohexane-1,2-diaminetetraacetic acid, pentetic acid, gluconic acid, tannic acid, malic acid, glycolic acid, pyruvic acid, glutamic acid, fumaric acid, succinic acid, isocitric acid, pimelic acid, oxalic acid, malonic acid, gluratic acid, adipic acid, propionic acid, butyric acid, carboxylic acid, sodium citrate, disodium citrate, potassium citrate, sodium carbonate, potassium carbonate, sodium bicarbonate, potassium bicarbonate, sodium tripolyphosphate, sodium hexametaphosphate, monopotassium dihydrogen orthophosphate, dipotassium hydrogen orthophosphate, tripotassium orthophosphate, monosodium phosphate, dipotassium phosphate, trisodium phosphate, tetrasodium pyrophosphate, sodium aluminum phosphate, sodium potassium tartrate, and combinations thereof. The treatment fluid may be a treatment fluid selected from the group consisting of drilling fluids, fracturing fluids, stimulation fluids, multiphase fluids, water-based fluids, oil-based fluids, acid-based fluids, foam-based fluids, and combinations thereof. The commercial solid may comprise a contaminant selected from the group consisting of fluid loss control agents, emulsifiers, dispersion aids, corrosion inhibitors, emulsion thinners, emulsion thickeners, viscosifying agents, gelling agents, crosslinking agents, surfactants, lost circulation materials, pH control additives, emulsion breakers, defoaming agents, biocides, stabilizers, scale inhibitors, gas hydrate inhibitors, oxidizers, reducers friction reducers, clay stabilizing agents, cement set accelerators, cement set retarders, drill solids, bridging agents, and combinations thereof. The commercial solids recovery unit may comprise a thermal desorption unit, a centrifugation unit, thermomechanical cuttings cleaner, or a combination thereof.

Referring now to FIG. 1, a block flow diagram is shown generally depicting an overview of the commercial solids treating and recycling system 5 for treating, recovering, and recycling commercial solids. As illustrated, a used treatment fluid 10 may be pumped from the wellbore to solids control equipment 15. Solids control equipment 15 may be used to remove any non-commercial solids which may be disposed within the used treatment fluid 10. For example, solids control equipment 15 may be used to remove drill cuttings from a used drilling fluid which has been circulated in a wellbore during a drilling application. Solids control equipment 15 may comprise shaker screens, centrifuges, and the like. Solids control equipment 15 is optional, and may not be used in all variations of the commercial solids treating and recycling system 5 described by FIG. 1. Inclusion of solids control equipment 15 is dependent on a variety of factors, including the type of used treatment fluid 10 and the presence of undesirable non-commercial solids, amongst others.

After the used treatment fluid 10 has interacted with the solids control equipment 15, chemical decontaminant 20 may be added to form a decontaminated used treatment fluid 25. The chemical decontaminant 20 may be added to the used treatment fluid 10 by any suitable method. For example, the chemical decontaminant 20 may be added to the used treatment fluid 10 as used treatment fluid 10 is being transported to the treatment fluid preparation unit 50. The chemical decontaminant 20 may be added to the used treatment fluid 10 as the used treatment fluid 10 is in a transporting conduit. Alternatively, the chemical decontaminant 20 may be added to the used treatment fluid 10 in a vessel where used treatment fluid 10 may be stored prior to or after transport to the treatment fluid preparation unit 50. With the benefit of this disclosure, one or ordinary skill in the art will be able to recognize a sufficient method to add and sufficiently mix chemical decontaminant 20 with treatment fluid 10. As used treatment fluid 10 may be disposed of after the commercial solids have been recovered, it is not necessary to remove chemical decontaminant 20 from the decontaminated used treatment fluid 25. After sufficient contact with chemical decontaminant 20, the commercial solids disposed within the decontaminated used treatment fluid 25 may be sufficiently decontaminated.

The decontaminated used treatment fluid 25 may then be transported to a commercial solids recovery unit 30. The commercial solids recovery unit 30 may comprise any system or method used to recover the commercial solids from the decontaminated used treatment fluid 25. The commercial solids recovery unit 30 may be a thermal desorption unit, solvent extraction method, and the like. In the example illustrated in FIG. 1, the commercial solids recovery unit 30 is a thermal desorption unit which separates the oil 35 and water 40 from the commercial solids. Without limitation, the recovered commercial solids 45 may be transported to another location and stored after their recovery in the commercial solids recovery unit 30. The recovered commercial solids 45 may then be transported to a treatment fluid preparation unit 50. Without limitation, the treatment fluid preparation unit 50 may be at a different location than the commercial solids recovery unit 30 (e.g., at a different well site) or the storage of the recovered commercial solids 45. Any suitable mode of transportation may be used to transport the recovered commercial solids 45 to the treatment fluid preparation unit 50. The treatment fluid preparation unit 50 may comprise any treatment fluid mixing and handling system or systems. For example the treatment fluid preparation unit 50 may generally comprise mixing equipment, pumping equipment, etc. In specific examples, the treatment fluid preparation unit 50 may comprise a hopper, jet mixer, re-circulating mixer, a batch mixer, any type of vessel for storing the treatment fluid or its component materials, a circulating pump, a liquid additive system, an additive tank, and the like. The treatment fluid preparation unit 50 may be used to produce a new treatment fluid 55 by adding and/or mixing the recovered commercial solids 45 with a carrier fluid or other materials which may be used to produce the new treatment fluid 55. New treatment fluid 55 may then be transported to the wellbore by any suitable method and used for any desirable application. Without limitation by theory, it is believed that the chemical decontaminant 20 may prevent recontamination of the commercial solids in the decontaminated used treatment fluid 25 prior to recovery of the commercial solids. Some of the potential contaminants that are removed may be dissolved and/or converted to a gas which may leave the solution. In other cases, the wettability of the commercial solids may be altered such that recontamination is made more difficult.

Figure 2:
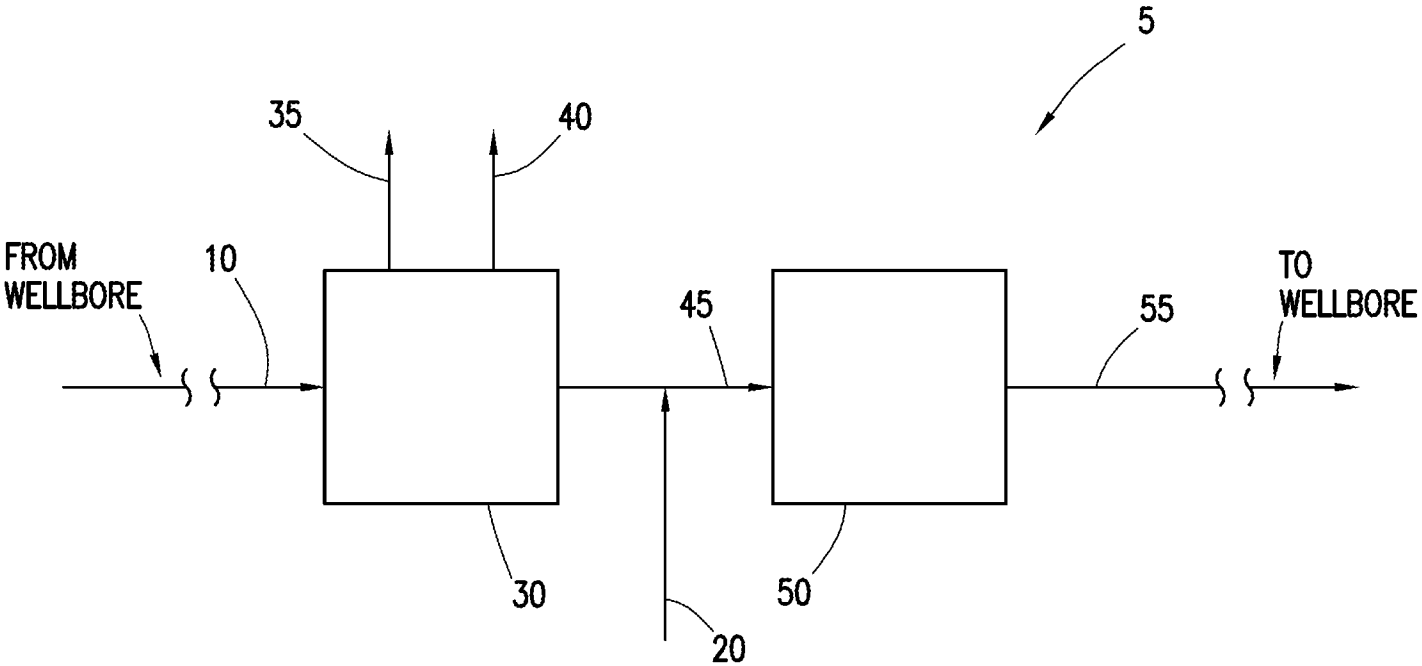
FIG. 2 is a block flow diagram illustrating an alternative example of a commercial solids treating and recycling system.

Referring now to FIG. 2, a block flow diagram depicts an alternative configuration of the commercial solids treating and recycling system 5 of FIG. 1, such that the commercial solids are recovered from the used treatment fluid 10 prior to treatment with the chemical decontaminant 20. As illustrated by FIG. 2, used treatment fluid 10 may be pumped from the wellbore to commercial solids recovery unit 30. Optionally, the used treatment fluid 10 may be first pumped to solids control equipment 15 as illustrated by FIG. 1. As with FIG. 1, the commercial solids recovery unit 30 separates the oil 35 and water 40 of the used treatment fluid 10 from the commercial solids and produces recovered commercial solids 45. After the commercial solids have been recovered by the commercial solids recovery unit 30, chemical decontaminant 20 may be added to the recovered commercial solids 45. The chemical decontaminant 20 may be added to the recovered commercial solids 45 by any suitable method. For example, the chemical decontaminant 20 may be added to the recovered commercial solids 45 as the recovered commercial solids 45 are being transported to the treatment fluid preparation unit 50, for example, the chemical decontaminant 20 may be added to the recovered commercial solids 45 as the recovered commercial solids 45 are in a transporting conduit. Alternatively, the chemical decontaminant 20 may be added to the recovered commercial solids 45 in a vessel where recovered commercial solids 45 may be stored prior to or after transport to the treatment fluid preparation unit 50. With the benefit of this disclosure, one or ordinary skill in the art will be able to recognize a sufficient way to add and sufficiently mix chemical decontaminant 20 with the recovered commercial solids 45. As the recovered commercial solids 45 may be recycled directly into a new treatment fluid 55 which may comprise new contaminants, it may not be necessary to remove chemical decontaminant 20 from the recovered commercial solids 45 after the recovered commercial solids 45 have been decontaminated, unless the chemical decontaminant 20 would have an adverse effect on the new treatment fluid to be prepared by the treatment fluid preparation unit 50. After sufficient contact with chemical decontaminant 20, the recovered commercial solids 45 may be sufficiently decontaminated and may be recycled into a new treatment fluid 55.

After decontamination, the recovered commercial solids 45 may then be transported to a treatment fluid preparation unit 50. Alternatively, the chemical decontaminant 20 may be included in the new treatment fluid prior to addition of the recovered commercial solids 45. Without limitation, the recovered commercial solids 45 may be added to a new treatment fluid that comprises a chemical decontaminant 20. As in the example of FIG. 1, the treatment fluid preparation unit 50 may comprise any treatment fluid mixing and handling system or systems. For example the treatment fluid preparation unit 50 may generally comprise mixing equipment, pumping equipment, etc. In specific examples, the treatment fluid preparation unit 50 may comprise a hopper, jet mixer, re-circulating mixer, a batch mixer, any type of vessel for storing the treatment fluid or its component materials, a circulating pump, a liquid additive system, an additive tank, and the like. The treatment fluid preparation unit 50 may be used to produce a new treatment fluid 55 by adding and/or mixing the recovered commercial solids 45 with a carrier fluid or other materials which may be used to produce the new treatment fluid 55. New treatment fluid 55 may then be transported to the wellbore by any suitable method and used for any desirable application. Without limitation, the recovered commercial solids 45 (prior to or after decontamination) may be stored at a location remote from the treatment fluid preparation unit 50, which may be at a well site. Any suitable mode of transportation may be used to transport the recovered commercial solids 45 to the treatment fluid preparation unit 50.

Figure 3:
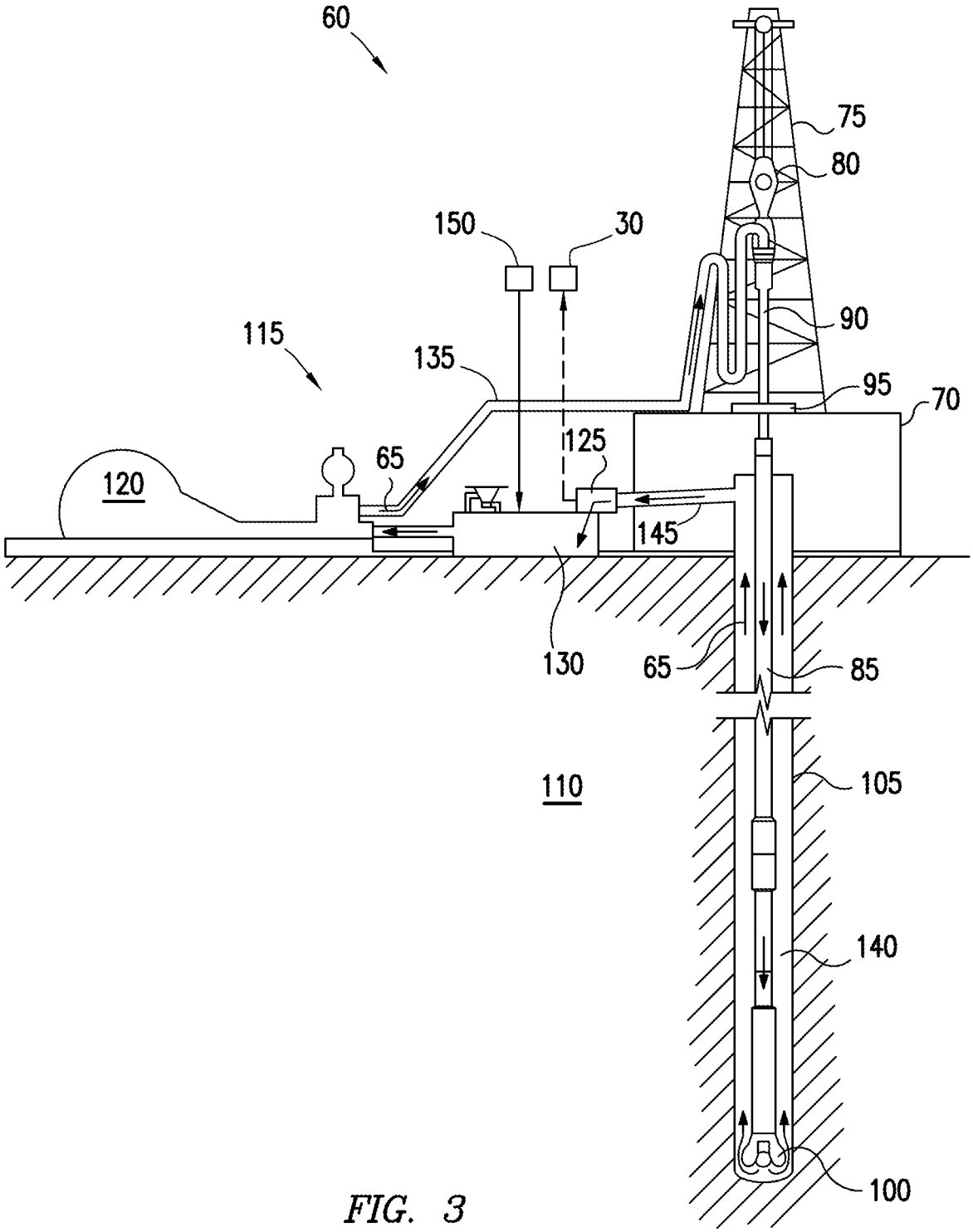
FIG. 3 illustrates a system for decontaminating a commercial solid disposed within a drilling fluid.

Referring now to FIG. 3, an alternative method of decontaminating commercial solids is illustrated. FIG. 3 depicts a drilling system 60 for drilling a wellbore with drilling fluid 65. Although a drilling fluid 65 is depicted as the treatment fluid, it is to be understood that the method of decontamination may be used for any treatment fluid and in any system in which said treatment fluid may be used. Also, it should be noted that while FIG. 3 generally depicts a land-based drilling system, those skilled in the art will readily recognize that the principles described herein are equally applicable to subsea drilling operations that employ floating or sea-based platforms and rigs, without departing from the scope of the disclosure.

As illustrated, the drilling system 60 may include a drilling platform 70 that supports a derrick 75 having a traveling block 80 for raising and lowering a drill string 85. The drill string 85 may include, but is not limited to, drill pipe and coiled tubing, as generally known to those skilled in the art. A kelly 90 may support the drill string 85 as it may be lowered through a rotary table 95. A drill bit 100 may be attached to the distal end of the drill string 85 and may be driven either by a downhole motor and/or via rotation of the drill string 85 from the well surface. Without limitation, the drill bit 100 may include, roller cone bits, PDC bits, natural diamond bits, any hole openers, reamers, coring bits, and the like. As the drill bit 100 rotates, it may create a wellbore 105 that penetrates various subterranean formations 110.

The drilling system 60 may further include a fluid monitoring and handling system 115 comprising component parts such as mud pump 120, one or more fluid reconditioning systems 125, and a mud pit 130. The mud pump 120 representatively includes any conduits, pipelines, trucks, tubulars, and/or pipes used to fluidically convey the drilling fluid 65 downhole; any pumps, compressors, or motors (e.g., topside or downhole) used to drive the drilling fluid 65 into motion; any valves or related joints used to regulate the pressure or flow rate of the drilling fluid 65; and any sensors (e.g., pressure, temperature, flow rate, etc.), gauges, and/or combinations thereof, and the like.

The mud pump 120 may circulate drilling fluid 65 through a feed pipe 135 and to the kelly 90, which may convey the drilling fluid 65 downhole through the interior of the drill string 85 and through one or more orifices in the drill bit 100. The drilling fluid 65 may then be circulated back to the surface via an annulus 140 defined between the drill string 85 and the walls of the wellbore 105. At the surface, the recirculated or used drilling fluid 65 may be conveyed to the fluid reconditioning system 125 via an interconnecting flow line 145. In some examples, the fluid reconditioning system 125 may include solids control equipment (e.g., solids control equipment 15 as shown in FIG. 1) to remove non-commercial solids such as drill cuttings from the drilling fluid 65). The fluid reconditioning system 125 may be used to generally return the drilling fluid 65 to its approximate original state before it is deposited in the mud pit 130. After passing through the fluid reconditioning system 125, a "cleaned" drilling fluid 65 may be deposited into a nearby mud pit 130. While illustrated as being arranged at the outlet of the wellbore 105 via the annulus 140, those skilled in the art will readily appreciate that the fluid reconditioning system 125 may be arranged at any other location in the drilling system 60 to facilitate its proper function, without departing from the scope of the scope of the disclosure.

Referring still to FIG. 3, the fluid monitoring and handling system 115 may further include a commercial solids recovery unit 30 and chemical decontaminant storage vessel 150, which may be disposed on a skid supported on the drilling platform 70. The commercial solids recovery unit 30 may, be included to recover the commercial solids from the used drilling fluid 65 so that they may be decontaminated and recycled if desired. The decontaminated recovered commercial solids may be used in the same (i.e. drilling fluid 65) or a different treatment fluid as desired. In the example illustrated by FIG. 3, the commercial solids recovery unit 30 is optional. With continued reference to FIG. 3, the chemical decontaminant storage vessel 150 may be used to store a supply of one or more chemical decontaminants (e.g., chemical decontaminants 20 as shown in FIGS. 1 and 2). As illustrated, one or more chemical decontaminants may be added to the drilling fluid 65 in mud pit 130 and then pumped via mud pump 120 into the wellbore 105 via drill string 85. The chemical decontaminants within the drilling fluid 65 may decontaminate the commercial solids within drilling fluid 65 allowing for longer use of the commercial solids within the drilling fluid 65 and reducing the contamination of the commercial solids over time. Further, if desired, the commercial solids may be recovered via commercial solids recovery unit 30 as discussed above. If the commercial solids are contaminated, the recovered commercial solids may be decontaminated before recycling into a new treatment fluid.

EXAMPLES

To facilitate a better understanding of the present claims, the following examples of certain aspects of the disclosure are given. In no way should the following examples be read to limit, or define, the entire scope of the claims.

Example 1

Example 1 is a comparative example which illustrates the rheological differences in the use of treatment fluids comprising uncontaminated commercial solids versus treatment fluids comprising contaminated commercial solids. Two control drilling fluids were prepared comprising the following formulations:

TABLE 1

| | 16.3 lb/gal Formulation | 12.5 lb/gal Formulation (The 16.3 lb/gal formulation with sea water added) |
|---|---|---|
| NaCl Brine 250,000 ppm, bbl | 0.75 | 0.52 bbl |
| Viscosifier, lb. | 2 | |
| Weighting Agent (New Commercial Solid) | 371.2 | |
| Seawater, bbl | — | 0.48 |

The viscosifier was BARAZAN®D PLUS Viscosifier available from Halliburton Energy Services, Inc. of Houston, Tex. The weighting agent was API barite, and was the commercial solid studied in the example.

Two experimental drilling fluids were prepared except the weighting agent was recycled barite, which had been recovered from another drilling fluid. The two experimental drilling fluids were prepared comprising the following formulation:

TABLE 2

| | 16.3 lb/gal Formulation | 12.5 lb/gal Formulation (The 16.3 lb/gal formulation with sea water added) |
|---|---|---|
| NaCl Brine 250,000 ppm, bbl | 0.69 | 0.52 bbl |
| Viscosifier, lb. | 2 | |
| Weighting Agent, lb. (Recovered Commercial Solid) | 395.9 | |
| Seawater, bbl | — | 0.48 |

The rheology of the control samples and the experimental samples were compared by using a using a Model 35A Fann® Viscometer and a No. 1 spring with a Fann® Yield Stress Adapter, in accordance with the procedure set forth in API RP 13-B1, Recommended Practice for Field Testing Water-based Drilling Fluids. The data is presented in Table 3 below.

TABLE 3

| | 16.3 lb/gal Control Formulation | 12.5 lb/gal Control Formulation | 16.3 lb/gal Experimental Formulation | 12.5 lb/gal Experimental Formulation |
|---|---|---|---|---|
| 600/300 | 163/110 | 46/31 | 211/176 | 29/16 |
| 6/3 | 33/29 | 7/6 | 54/48 | 1/0 |
| Plastic Viscosity (cP)/Yield Point (lbf/100 $ft^2$) | 53/57 | 15/16 | 35/141 | 13/3 |
| 10 sec./ 10 min. gels | 28/35 | 5/7 | 41/49 | N/A |

The differences in fluid rheology led to further investigation to discern the potential cause of the thickening effect observed from Table 3. Using x-ray diffraction, the new commercial solid (API barite) was compared to the recovered commercial solid (recycled barite). The results are presented in Table 4 below:

TABLE 4

| | API Barite | Recycled Barite |
|---|---|---|
| Barite, wt. % | 87 | 75 |
| Quartz, wt. % | 6 | 12 |
| Calcite, wt. % | 3 | 13 |
| Dolomite, wt. % | 4 | trace |

Figure 4:
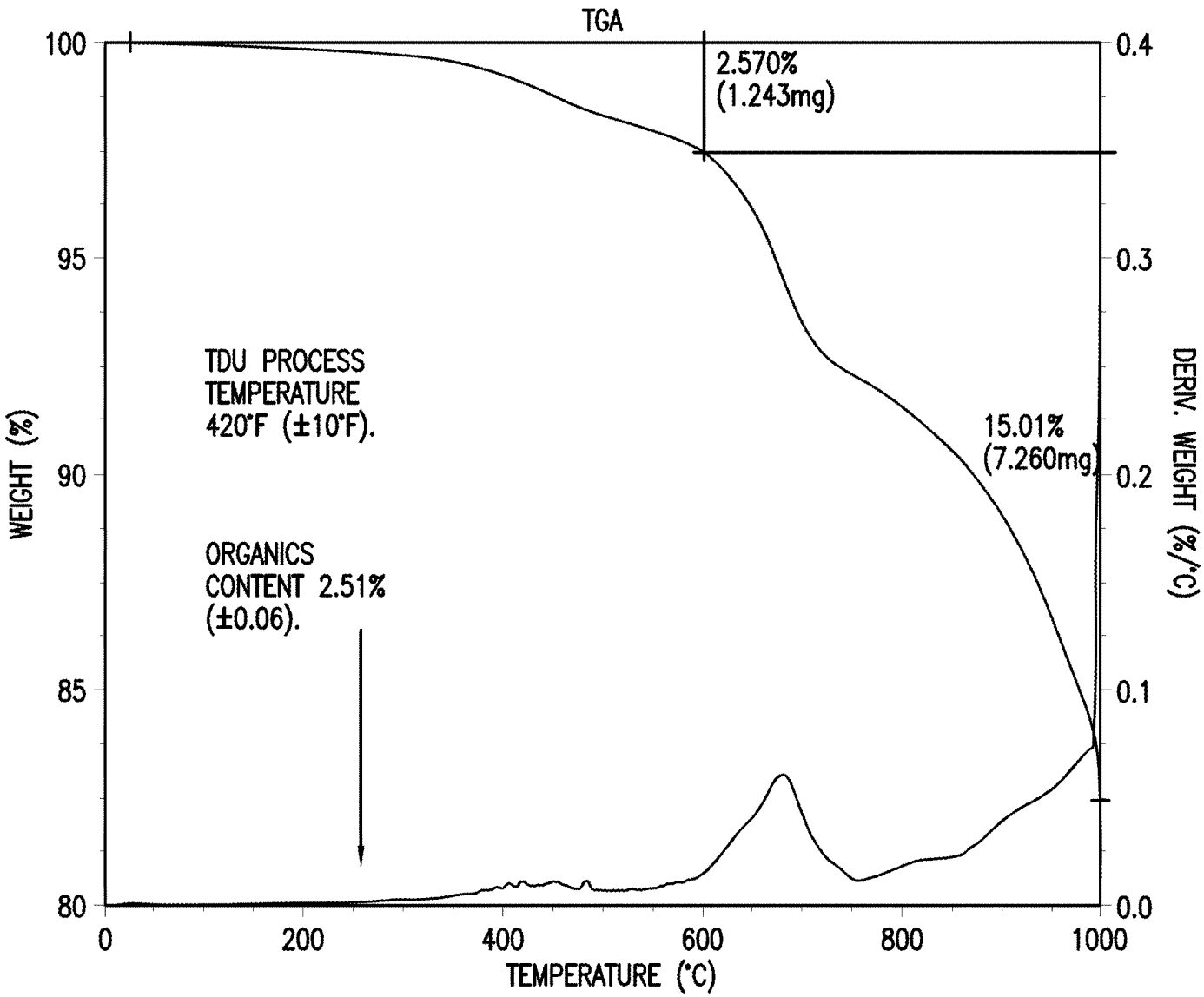
FIG. 4 illustrates a thermogravimetric analysis of a sample of a contaminated commercial solid.

The analysis illustrated that the recycled barite had greater than four times the amount of calcite as compared to the new barite. Additionally, as illustrated by the thermogravimetric analysis data on FIG. 4, a significant amount of organics were found on the recycled barite. Additionally, the specific gravity of the recycled barite was only 3.65, which is significantly lower than that of the API barite which was 4.2.

Example 2

Based on the data observed in Example 1, a method of treating recovered commercial solids was developed. A chemical decontaminant, specifically, sodium acid pyro phosphate, was added directly to some example drilling fluids comprising the following formulations:

TABLE 5

| | 16.3 lb/gal Formulation | 12.5 lb/gal Formulation (The 16.3 lb/gal formulation with sea water added) | 12.5 lb/gal Formulation with additional viscosifier added) |
|---|---|---|---|
| NaCl Brine 250,000 ppm, bbl | 0.66 | 0.52 bbl | — |
| Viscosifier, lb. | 2 | | 0.50 |
| Weighting Agent, lb. (Recovered Commercial Solid) | 398.1 | | — |
| Chemical Decontaminant, lb. | 9 | | — |
| Seawater, bbl | — | 0.48 | — |

The viscosifier was BARAZAN®D PLUS Viscosifier available from Halliburton Energy Services, Inc. of Houston, Tex. The additional viscosifier was added to increase viscosity after the seawater addition. The weighting agent was recovered barite, and was the commercial solid studied in the example. After the fluids were prepared, the rheology data was measured using a Model 35A Fann® Viscometer and a No. 1 spring with a Fann® Yield Stress Adapter, in accordance with the procedure set forth in API RP 13-B1, Recommended Practice for Field Testing Water-based Drilling Fluids. The data is presented in Table 6 below.

TABLE 6

| | 16.3 lb/gal Formulation | 12.5 lb/gal Formulation (The 16.3 lb/gal formulation with sea water added) | 12 5 lb/gal Formulation with additional viscosifier added) |
|---|---|---|---|
| 600/300 | >300/230 | 38/26 | 50/36 |
| 6/3 | 58/49 | 4/3 | 9/7 |

TABLE 6-continued

| | 16.3 lb/gal Formulation | 12.5 lb/gal Formulation (The 16.3 lb/gal formulation with sea water added) | 12 5 lb/gal Formulation with additional viscosifier added) |
|---|---|---|---|
| Plastic Viscosity (cP)/Yield Point (lbf/100 ft$^2$) | — | 12/14 | 14/22 |
| 10 sec./ 10 min. gels | N/A | N/A | 7/9 |

After seven days of static sitting, the samples were still fluid. Thus, the components used did not adversely affect the pumpability of the fluid.

Example 3

Another method of treating recovered commercial solids was developed. A chemical decontaminant, specifically, a 15% citric acid solution was used to wash recovered barite and then vacuum filtration was performed on the recovered barite before placing the recovered barite in an oven at 150° F. overnight. The decontaminated barite was then recycled by adding it to some example drilling fluids in the formulations shown in Table 7. One of the fluids comprised a portion of the recovered barite was aged for seven days on a counter.

TABLE 7

| | 16.3 lb/gal Formulation | 12.5 lb/gal Formulation (The 16.3 lb/gal formulation with sea water added) | The 16.3 lb/gal formulation but with the seven day aged barite |
|---|---|---|---|
| NaCl Brine 250,000 ppm, bbl | 0.69 | 0.52 bbl | 0.69 |
| Viscosifier, lb. | 2 | | 2 |
| Weighting Agent, lb. (Recovered Commercial Solid) | 395.9 | | 395.9 |
| Seawater, bbl | — | 0.48 | — |

The viscosifier was BARAZAN®D PLUS Viscosifier available from Halliburton Energy Services, Inc. of Houston, Tex. The weighting agent was recovered barite, and was the commercial solid studied in the example. After the fluids were prepared, the rheology data was measured using a Model 35A Fann® Viscometer and a No. 1 spring with a Fann® Yield Stress Adapter, in accordance with the procedure set forth in API RP 13-B1, Recommended Practice for Testing Well Cements. The data is presented in Table 8 below.

TABLE 8

| | 16.3 lb/gal Formulation | 12.5 lb/gal Formulation (The 16.3 lb/gal formulation with sea water added) | The 16.3 lb/gal formulation but with the seven day aged barite |
|---|---|---|---|
| 600/300 | 230/168 | 48/34 | 250/187 |
| 6/3 | 46/40 | 7/6 | 53/46 |
| Plastic Viscosity (cP)/Yield Point (lbf/100 ft$^2$) | 62/106 | 14/20 | 63/124 |
| 10 sec./ 10 min. gels | 39/45 | 6.5/8 | 44/48 |

After seven days of static sitting, the samples were still fluid. Thus, the components used did not adversely affect the pumpability of the fluid. X-ray diffraction analysis was performed on the acid washed barite and the data is listed in Table 9 below.

TABLE 9

| | Recycled Barite |
|---|---|
| Barite, wt. % | 80 |
| Quartz, wt. % | 15 |
| Calcite, wt. % | 3 |
| Dolomite, wt. % | 2 |

When compared to the X-ray diffraction study of Table 4, it can be shown that acid washing the contaminated barite, reduces the calcite concentration.

The preceding description provides various embodiments of the systems and methods of use disclosed herein which may contain different method steps and alternative combinations of components. It should be understood that, although individual embodiments may be discussed herein, the present disclosure covers all combinations of the disclosed embodiments, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, and may be modified and practiced in different but equivalent manners apparent to those skilled in the art having the benefit of the teachings herein. Although individual embodiments are discussed, the disclosure covers all combinations of all of the embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of those embodiments. If there is any conflict in the usages of a word or term in this specification and one or more patent(s) or other documents that may be incorporated herein by reference, the definitions that are consistent with this specification should be adopted.

What is claimed is:

1. A method comprising:

recovering at least a portion of a commercial solid comprising a weighting agent from a first treatment fluid using a thermal desorption unit, wherein the first treatment fluid is recovered from a wellbore;

contacting the at least a portion of the commercial solid with a chemical decontaminant to produce a decontaminated commercial solid;

preparing a second treatment fluid comprising the commercial solid;

introducing the second treatment fluid comprising the commercial solid into a wellbore.

2. The method of claim 1 wherein contacting the commercial solid with the chemical decontaminant comprises contacting a recovered solid mixture with the chemical decontaminant, wherein the recovered solid mixture comprises the commercial solid and one or more solids selected from the group consisting of drill cuttings, drilling mud waste recovery, oil based drilling fluid waste recovery, water based drilling fluid waste recovery, brine based drilling fluid waste recovery and combinations thereof.

3. The method of claim 1, wherein the weighting agent is selected from the group consisting of barite, hematite, siderite, ilmenite, permanganate, and combinations thereof.

4. The method of claim 1, wherein the chemical decontaminant is selected from the group consisting of an acid, a chelating agent, a complexing agent, a thinner, and combinations thereof.

5. The method of claim 1, wherein the chemical decontaminant is selected from the group consisting of sodium acid pyrophosphate, potassium acid pyrophosphate, formic acid, acetic acid, hydrochloric acid citric acid, methyl sulfonic acid, ethylenediaminetetraacetic acid, cyclohexane-1, 2-diaminetetraacetic acid, pentetic acid, gluconic acid, tannic acid, malic acid, glycolic acid, pyruvic acid, glutamic acid, fumaric acid, succinic acid, isocitric acid, pimelic acid, oxalic acid, malonic acid, gluratic acid, adipic acid, propionic acid, butyric acid, carboxylic acid, sodium citrate, disodium citrate, potassium citrate, sodium carbonate, potassium carbonate, sodium bicarbonate, potassium bicarbonate, sodium tripolyphosphate, sodium hexametaphosphate, monopotassium dihydrogen orthophosphate, dipotassium hydrogen orthophosphate, tripotassium orthophosphate, monosodium phosphate, dipotassium phosphate, trisodium phosphate, tetrasodium pyrophosphate, sodium aluminum phosphate, sodium potassium tartrate, and combinations thereof.

6. The method of claim 1, wherein the first treatment fluid is a treatment fluid selected from the group consisting of drilling fluids, fracturing fluids, stimulation fluids, multiphase fluids, water-based fluids, oil-based fluids, acid-based fluids, foam-based fluids, and combinations thereof.

7. The method of claim 1, wherein the second treatment fluid is a treatment fluid selected from the group consisting of drilling fluids, fracturing fluids, stimulation fluids, multiphase fluids, water-based fluids, oil-based fluids, acid-based fluids, foam-based fluids, and combinations thereof.

8. The method of claim 1, wherein the first treatment fluid is a different type of treatment fluid from the second treatment fluid.

9. The method of claim 1, wherein the commercial solid comprises a contaminant selected from the group consisting of fluid loss control agents, emulsifiers, dispersion aids, corrosion inhibitors, emulsion thinners, emulsion thickeners, viscosifying agents, gelling agents, crosslinking agents, surfactants, lost circulation materials, pH control additives, emulsion breakers, defoaming agents, biocides, stabilizers, scale inhibitors, gas hydrate inhibitors, oxidizers, reducers friction reducers, clay stabilizing agents, cement set accelerators, cement set retarders, drill solids, bridging agents, and combinations thereof; and wherein the contacting the commercial solid with a chemical decontaminant to produce a decontaminated commercial solid comprises removing the selected contaminant or combination of contaminants.

10. The method of claim 1, wherein the recovering at least a portion of the commercial solid from the first treatment fluid occurs prior to the contacting the commercial solid with the chemical decontaminant to produce the decontaminated commercial solid.

11. The method of claim 1, wherein the contacting the commercial solid with the chemical decontaminant to produce the decontaminated commercial solid comprises adding the chemical decontaminant to the first treatment fluid and thereafter recovering at least a portion of the commercial solid from the first treatment fluid.

12. The method of claim 1, wherein the contacting the commercial solid with a chemical decontaminant to produce a decontaminated commercial occurs in the second treatment fluid.

13. A method comprising:

introducing a treatment fluid comprising a commercial solid, the commercial solid comprising a weighting agent, into a thermal desorption unit and recovering at least a portion of the commercial solid;

adding the at least a portion of the commercial solid to a treatment fluid comprising a chemical decontaminant such that the chemical decontaminant contacts the at least a portion of the commercial solid to produce a decontaminated commercial solid; and introducing the treatment fluid comprising the decontaminated commercial solid and the chemical decontaminant in a wellbore.

14. The method of claim 13, wherein the adding the at least a portion of the commercial solid to a treatment fluid comprises adding a recovered solid mixture to the treatment fluid, wherein the recovered solid mixture comprises the commercial solid and one or more solids selected from the group consisting of drill cuttings, drilling mud waste recovery, oil based drilling fluid waste recovery, water based drilling fluid waste recovery, brine based drilling fluid waste recovery and combinations thereof.

15. The method of claim 13, wherein the weighting agent selected from the group consisting of barite, hematite, siderite, ilmenite, permanganate, and combinations thereof, and wherein the chemical decontaminant is selected from the group consisting of an acid, a chelating agent, a complexing agent, a thinner, and combinations thereof.

16. The method of claim 13, wherein the chemical decontaminant is selected from the group consisting of sodium acid pyrophosphate, potassium acid pyrophosphate, formic acid, acetic acid, hydrochloric acid citric acid, methyl sulfonic acid, ethylenediaminetetraacetic acid, cyclohexane-1, 2-diaminetetraacetic acid, pentetic acid, gluconic acid, tannic acid, malic acid, glycolic acid, pyruvic acid, glutamic acid, fumaric acid, succinic acid, isocitric acid, pimelic acid, oxalic acid, malonic acid, gluratic acid, adipic acid, propionic acid, butyric acid, carboxylic acid, sodium citrate, disodium citrate, potassium citrate, sodium carbonate, potassium carbonate, sodium bicarbonate, potassium bicarbonate, sodium tripolyphosphate, sodium hexametaphosphate, monopotassium dihydrogen orthophosphate, dipotassium hydrogen orthophosphate, tripotassium orthophosphate, monosodium phosphate, dipotassium phosphate, trisodium phosphate, tetrasodium pyrophosphate, sodium aluminum phosphate, sodium potassium tartrate, and combinations thereof.

17. The method of claim 13, wherein the treatment fluid is selected from the group consisting of drilling fluids, fracturing fluids, stimulation fluids, multiphase fluids, water-based fluids, oil-based fluids, acid-based fluids, foam-based fluids, and combinations thereof.

18. The method of claim 13, wherein the commercial solid comprises a contaminant selected from the group consisting of fluid loss control agents, emulsifiers, dispersion aids, corrosion inhibitors, emulsion thinners, emulsion thickeners, viscosifying agents, gelling agents, crosslinking agents, surfactants, lost circulation materials, pH control additives, emulsion breakers, defoaming agents, biocides, stabilizers, scale inhibitors, gas hydrate inhibitors, oxidizers, reducers friction reducers, clay stabilizing agents, cement set accelerators, cement set retarders, drill solids, bridging agents, and combinations thereof and wherein the chemical decontaminant removes the selected contaminant or combination of contaminants from the commercial solid.

* * * * *